US006758578B1

(12) United States Patent
Chou

(10) Patent No.: US 6,758,578 B1
(45) Date of Patent: Jul. 6, 2004

(54) T TYPE QUICK-LOCK LAMPHOLDER

(76) Inventor: Tsung-Yuan Chou, No. 3, Lane 328, Sec. 3, Chung-Hsin Rd., Chutung, Hsinchu 310 (TW)

( * ) Notice: Subject to any disclaimer, the term of this patent is extended or adjusted under 35 U.S.C. 154(b) by 0 days.

(21) Appl. No.: 10/458,315

(22) Filed: Jun. 11, 2003

(51) Int. Cl.[7] ..... F21V 21/00; H01R 33/00

(52) U.S. Cl. ..... 362/226; 362/391; 362/806; 439/419

(58) Field of Search ..... 362/226, 391, 362/806; 439/419, 280

(56) References Cited

U.S. PATENT DOCUMENTS 5,526,250 A * 6/1996 Ting et al. ..... 362/391
5,601,448 A * 2/1997 Poon ..... 439/419
5,660,560 A * 8/1997 Cheng et al. ..... 439/419
5,660,561 A * 8/1997 Tseng ..... 439/419
5,670,847 A * 9/1997 Lin ..... 315/185 S
6,116,944 A * 9/2000 Tseng ..... 439/419
6,367,952 B1 * 4/2002 Gibboney, Jr. ..... 362/249
6,537,101 B1 * 3/2003 Wang ..... 439/417

* cited by examiner

*Primary Examiner*—Thomas M. Sember
(74) *Attorney, Agent, or Firm*—Troxell Law Office PLLC

(57) ABSTRACT

A lamp holder includes a socket and a cap. The socket is provided at a rear end with a wire groove and two piercing terminals upward projected from the wire groove. The cap has a top recess to provide a bottom surface. To assemble the lamp holder to an cable, simply position the wire in the wire groove and screw the cap onto the rear end of the socket. The bottom surface of the cap and areas at two lower opposite sides of the cap evenly apply forces in the same direction to three serial points on the cable while pressing the latter against the piercing terminals, so that the cable is quickly and accurately pierced through to electrically connect to the lamp holder. The lamp holder may also be connected to a universal link, a lampshade and the like for use at different places.

8 Claims, 12 Drawing Sheets

T TYPE QUICK-LOCK LAMPHOLDER

FIELD OF THE INVENTION

The present invention relates to a lamp holder, and more particularly to a lamp holder that enables quick and even accurate piercing of an cable connected thereto without using any tool, and may have a fuse, a universal link, a spike, a lamp panel, or a lampshade connected thereto to provide different manners of use thereof.

BACKGROUND OF THE INVENTION

Generally, a conventional lamp holder, including the lamp holder for a light string, has a structural design that requires traditional ways of assembling, such as fastening by means of screws, tenons and mortises, rivets, supersonic wave, glue, etc. with the help of suitable tools or machines. Thus, the conventional lamp holder has to be manufactured and assembled in a plant or factory. Moreover, following drawbacks are found in the use of the conventional lamp holders:

1. The conventional lamp holders for a light string have fixed specifications and are arranged on the light string at fixed intervals. Therefore, the conventional lamp holders could not be arranged to show special patterns according to specific ornaments to be decorated or personal preference. The light string using the conventional lamp holders are therefore normally used in Christmas time and other festivals only.
2. The conventional lamp holders are not provided with overcurrent protective means, and are therefore not safe for use. There are chances lamp bulbs of high wattage are mounted on the conventional lamp holders to result in overloaded wires and burnt out lamp bulbs.
3. The conventional lamp holders are not provided with means for well fixing the lamp holders to wall panels or other mounting surfaces. Most conventional lamp holders for use outdoors are simply seated in holes or hung on hangers or fixed with nails provided on the wall panels or mounting surfaces. And, it is uneasy to control the length of cables connected to the lamp holders. The lamp holders under strong wind tend to swing and break due to collision with the walls or mounting surfaces, resulting in dark portions on the wall or object surfaces decorated with lamp bulbs to spoil the overall beauty of the decorated walls or objects.

FIG. 12 is a plan view of a currently available lamp holder. As shown, this type of lamp holder is provided at an upper part with piercing terminals that directly pierce through an cable to electrically connect the latter to the lamp holder to save the effort of stripping off the wire sheath. The piercing terminals may be located in the lamp holder at a desired height. In a common practice, the piercing terminals are embedded in a hole in the lamp holder. An cable is connected to the lamp holder by forcing it into the hole to be pierced through by the piercing terminals. And, a barb on each of the piercing terminals functions to retain the cable in the hole. However, in using this type of lamp holder with piercing terminals, it is frequently found the cable is not effectively pierced to electrically connect the lamp holder to conductors in the cable, or the cable subject to an external force tends to separate from the lamp holder easily.

In an improved version of the above-described conventional lamp holder with piercing terminals provided near an open top thereof, screw holes are further provided on the lamp holder close to the piercing terminals. The cable is pressed against the open top of the lamp holder with a hold-down cap. Screws are then extended through the screw holes to force the cable against the piercing terminals, so that the cable is pierced through and fixed in place in the lamp holder by the piercing terminals. This improved type of lamp holder enables better wire connection but requires tools to complete the assembling of the cable to the lamp holder. Moreover, since the screws at two sides of the cable are sequentially tightened, it is possible the cable is not evenly forced against the piercing terminals to result in a misaligned, skidded, or inaccurately pierced cable.

In addition, both of the above two conventional lamp holders have fixed structure and appearance for use in some fixed manners. They are not adapted to associate with other types of fixtures for decorating at different places, and therefore have limited applications.

It is therefore tried by the inventor to develop an improved lamp holder to overcome the drawbacks existed in the conventional lamp holders.

SUMMARY OF THE INVENTION

A primary object of the present invention is to provide a lamp holder, to which an cable may be easily connected without using any tool. The lamp holder is so structured that it enables even application of force in the same direction to three serial points on the cable assembled thereto, so that the cable is quickly and accurately pierced through and accordingly, electrically connected to the lamp holder without the risks of becoming misaligned with or skidded off the piercing terminals.

Another object of the present invention is to provide an improved lamp holder that is adapted to associate with different fixtures, such as a sucker, a magnet, a universal link, a spike, a lamp panel, a lampshade, etc., to enable a wide range of applications thereof.

A further object of the present invention is to provide an improved lamp holder having a fuse-connected piercing terminal that can be replaced at any time to ensure the safety in using the lamp holder.

To achieve the above and other objects, the lamp holder of the present invention mainly includes a socket and a cap.

The socket is internally provided at predetermined positions near a rear end thereof with piercing terminals for directly piercing through an cable assembled to the socket and thereby electrically connecting the cable to the lamp holder. The socket is also formed at the rear end with an axially extended and externally threaded first connecting head and a rear flange radially outward extended from a root of the first connecting head. Two wiring notches are oppositely provided on the first connecting head, and a sunken wire groove is provided on the rear end and the rear flange of the socket to extend between the two wiring notches. The wire groove is provided at predetermined positions on a bottom thereof with openings, via which the piercing terminals in the socket are outward projected.

The cap is internally provided with screw threads for engaging with the externally threaded first connecting head of the socket, and has a top recess to provide a bottom surface adapted to press against the cable positioned in the wire groove. The cap has a cap flange radially outward extended from a periphery of an end of the cap facing toward the socket.

When the cable is connected to the lamp holder by positioning the cable in the sunken wire groove and tightening the cap to the first connecting head of the socket, the bottom surface of the top recess of the cap and two areas of the cap flange at two opposite sides of the bottom surface together compress against the cable to evenly apply forces in the same direction to three serial points, that is, a front, a middle, and a rear point, on the cable, so that the cable is quickly pierced through by the piercing terminals projected from the wire groove without becoming misaligned with or skidded off the piercing terminals.

One of the piercing terminals may be connected to a auto-reset fuse to ensure the safety in using the lamp holder.

The top recess of the cap is provided with a universal socket for connecting to a universal joint ball provided at an end of a universal link, such that the lamp holder may be turned by 360 degrees or adjusted to different height relative to a fixed location after the universal link is connected at another end to the fixed location. The lamp holder may therefore be used at different places for different purposes, such as a decorative illumination on a signboard, in a show window, on an exterior wall of a building, or in a garden, or as a general lighting fixture in offices, or other working places, or on streets.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
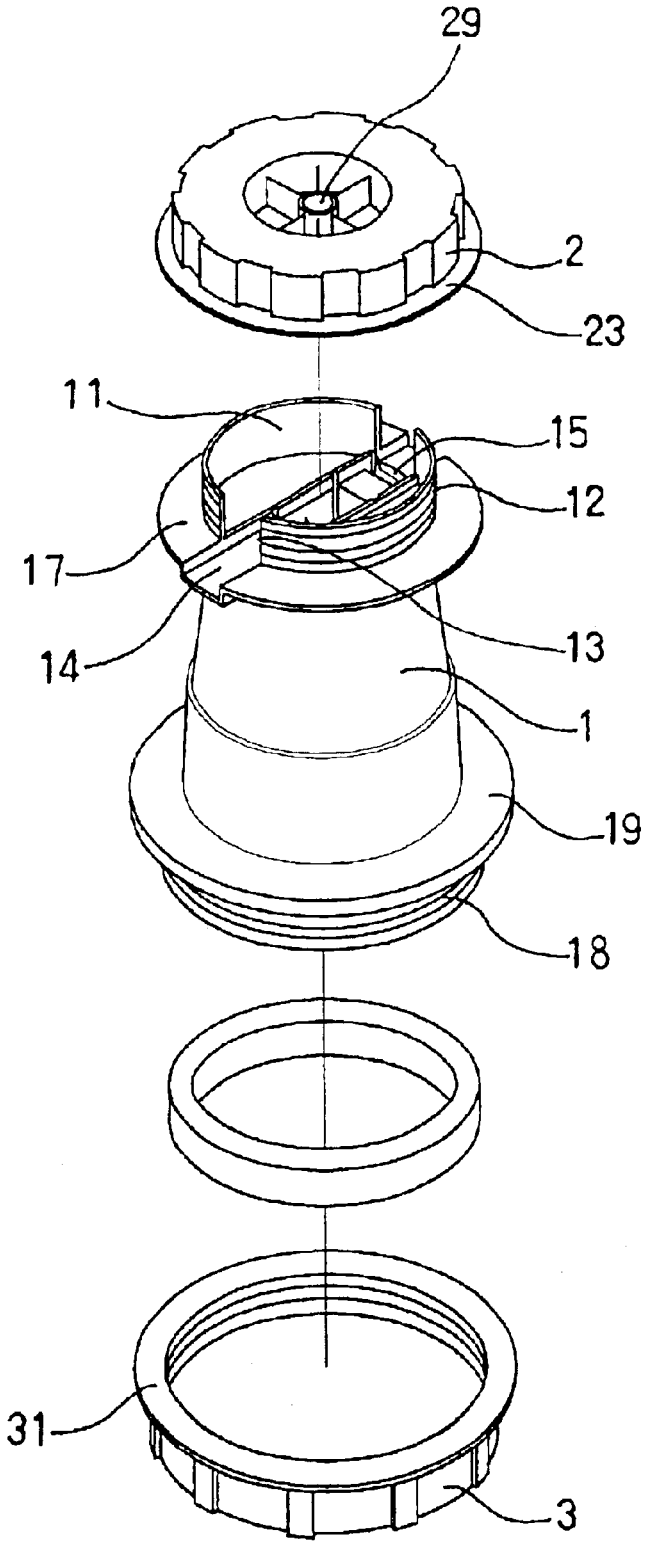
FIG. 1 is an exploded perspective view of a lamp holder according to an embodiment of the present invention.
Figure 2:
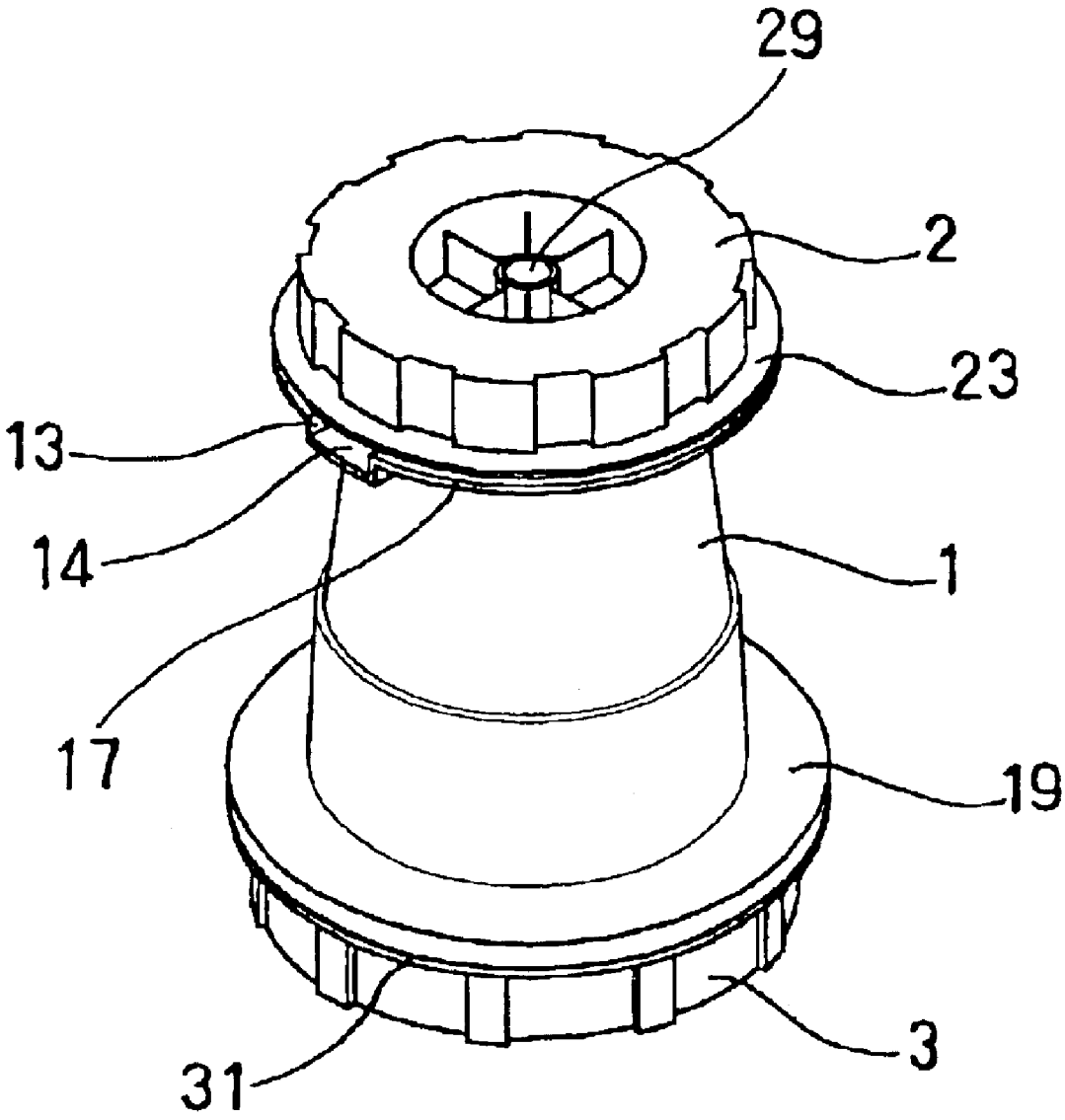
FIG. 2 is an assembled perspective view of FIG. 1.
Figure 3:
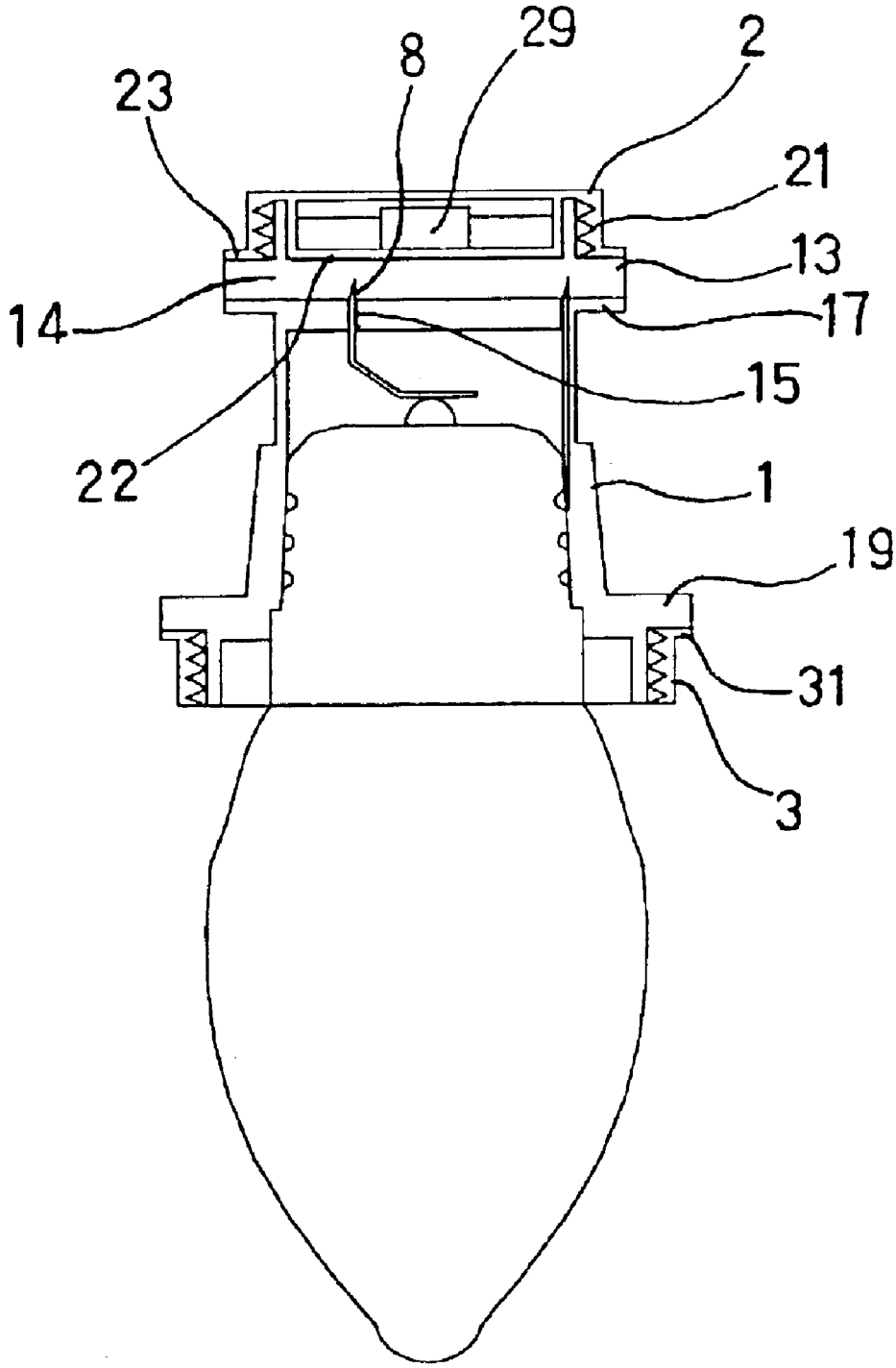
FIG. 3 is an assembled sectional view of FIG. 2 with a lamp bulb connected thereto.

Please refer to FIGS. 1, 2, and 3 in which a lamp holder according to an embodiment of the present invention is shown. The lamp holder mainly includes a socket 1 and a cap 2. The socket 1 is internally provided at predetermined positions near a rear end thereof with piercing terminals 8, which are adapted to directly pierce through an cable 7 assembled to the rear end of the socket 1 and pressed against the piercing terminals 8 (see FIG. 4) and there by save a user's efforts of stripping the wire to electrically connect the wire to the lamp holder. The socket 1 is formed at the rear end with an axially extended first connecting head 11, which is externally provided with screw threads 12, and a rear flange 17 radially outward extended from a root of the first connecting head 11. Two wiring notches 13 are oppositely provided on the first connecting head 11, and a sunken wire groove 14 is provided on the rear end and the rear flange 17 of the socket 1 to extend between the two wiring notches 13. The wire groove 14 is provided at predetermined positions on a bottom thereof with openings 15, from which the piercing terminals 8 in the socket 1 are outward projected.

The cap 2 is provided with internal screw threads 21 that can mesh with the external screw threads 12 on the first connecting head 11 to lock the cap 2 to the rear end of the socket 1. As can be clearly seen from FIG. 3, the cap 2 has a top recess having a complete bottom surface 22 facing toward the piercing terminals 8, and a cap flange 23 radially outward extended from a periphery of an end of the cap 2 facing toward the socket 1.

Figure 4:
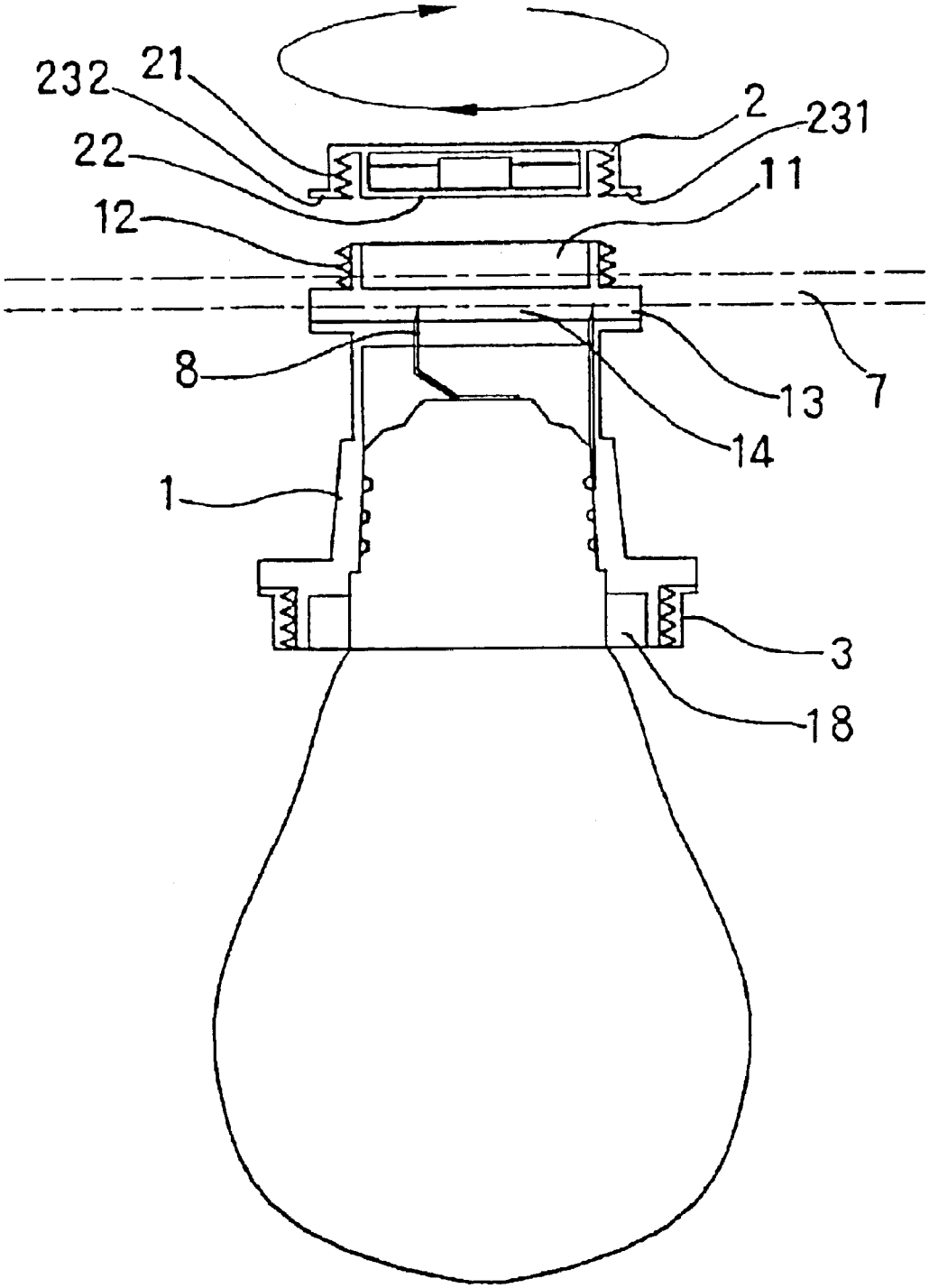
FIG. 4 shows the manner of connecting an cable to the lamp holder of the present invention.

Please refer to FIGS. 1 and 4. To assemble the cable 7 to the lamp holder, simply position the cable 7 in the wiring notches 13 and the sunken wire groove 14 and tighten the cap 2 to the first connecting head 11 of the socket 1. While the cap 2 is gradually tightened against the first connecting head 11, the bottom surface 22 of the cap 2 and two areas 231, 232 of the cap flange 23 at two opposite sides of the bottom surface 22 together compress against the cable 7 to evenly apply forces in the same direction to three-serial points, that is, a front, a middle, and a rear point, on the cable 7, as a result of the principle of clamp thread. The cable 7 is therefore quickly in contact with the piercing terminals 8 projected from the openings 15 on the wire groove 14. When the cable 7 is pierced through by the piercing terminals 8, it is electrically connected to the lamp holder. Since the cable 7 is positioned in the wire groove 14 and subject to even forces applied thereto in the same direction and to three serial points thereon, the problem of an cable misaligned with or skidded off the piercing terminals 8 could be avoided. That is, the cable 7 maybe quickly located on the socket 1 and accurately pierced to electrically connect to the lamp holder without the risk of being incompletely pierced to cause a poor connection.

Figure 5:
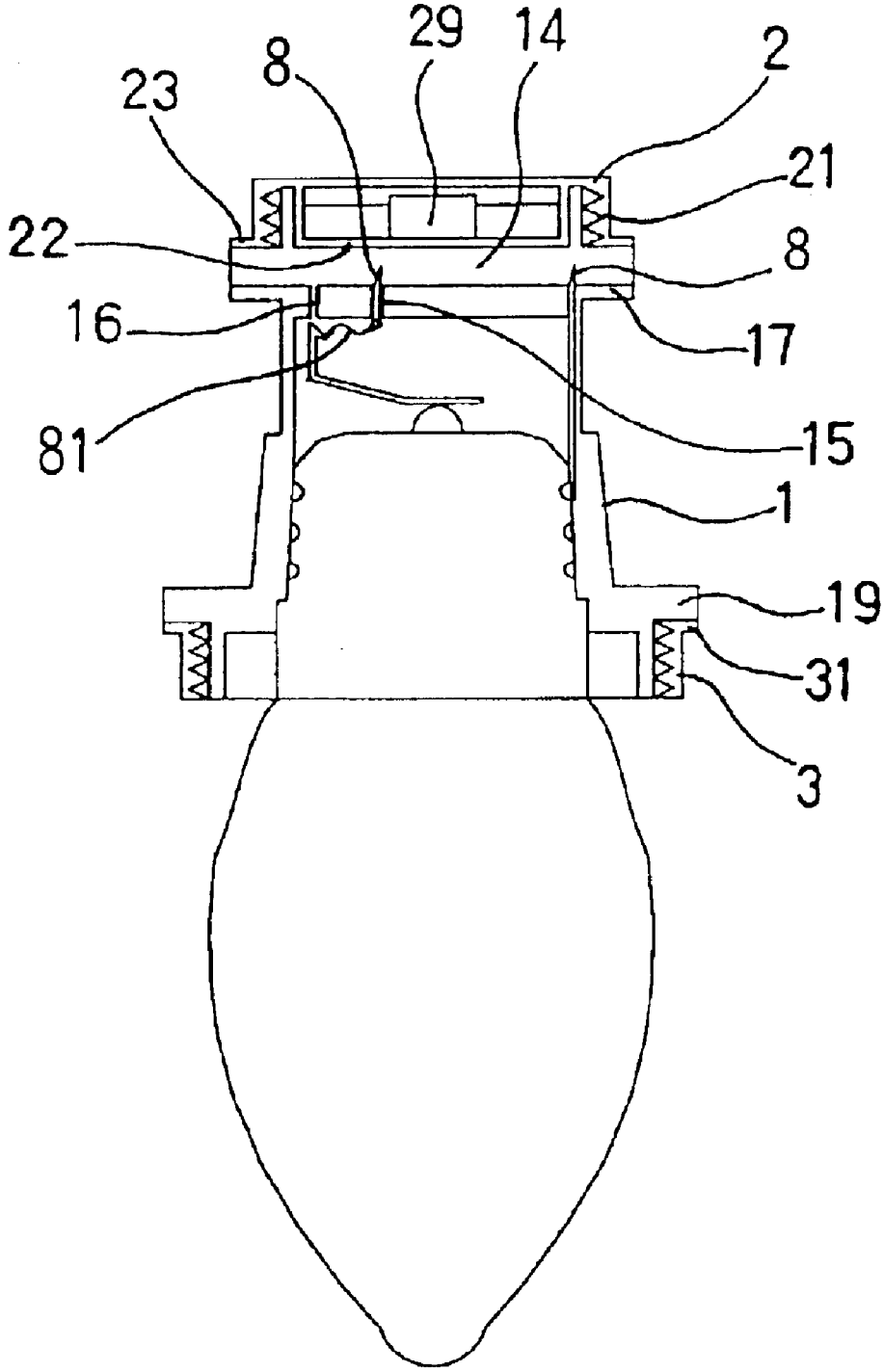
FIG. 5 shows the lamp holder of the present invention having are placeable fuse-connected piercing terminal.

Please refer to FIG. 5. To ensure the safety in using the lamp holder of the present invention, the wire groove 14 may be further provided with a replacement opening 16, and one of the piercing terminals 8 is connected to a auto-reset fuse 81. In the event a lamp bulb having a high wattage is wrongly connected to the lamp holder, the fuse-connected piercing terminal 8 is adapted to provide an overcurrent protection, making the lamp holder of the present invention safer for use. In the event the fuse 81 is burnt out, it may be replaced via the replacement opening 16.

Figure 6:
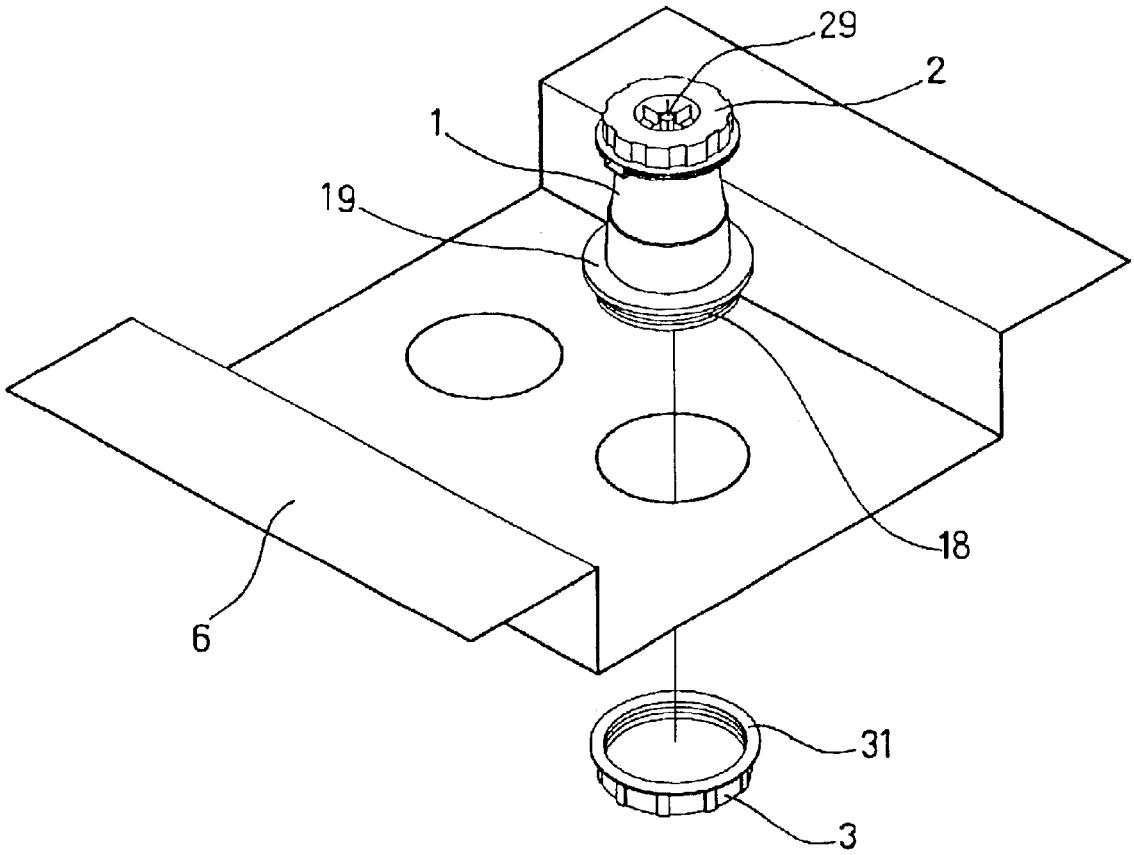
FIG. 6 shows the manner of mounting the lamp holder of the present invention on an orifice plate.
Figure 7:
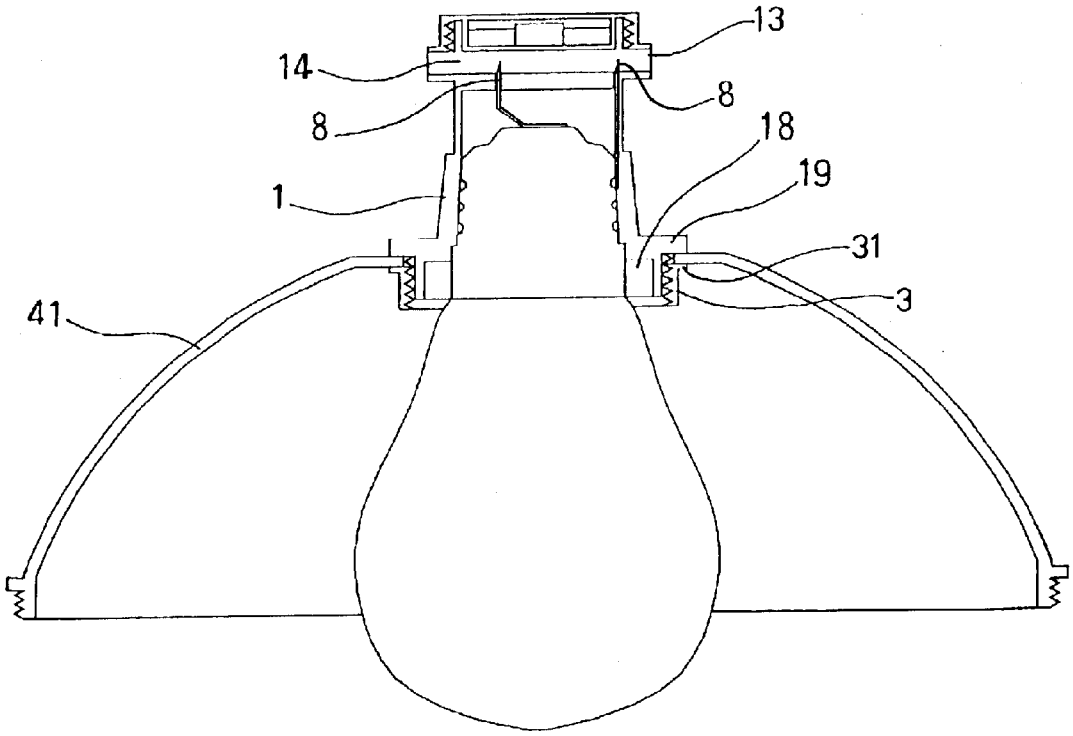
FIG. 7 shows the lamp holder of the present invention having a lamp panel connected thereto.
Figure 8:
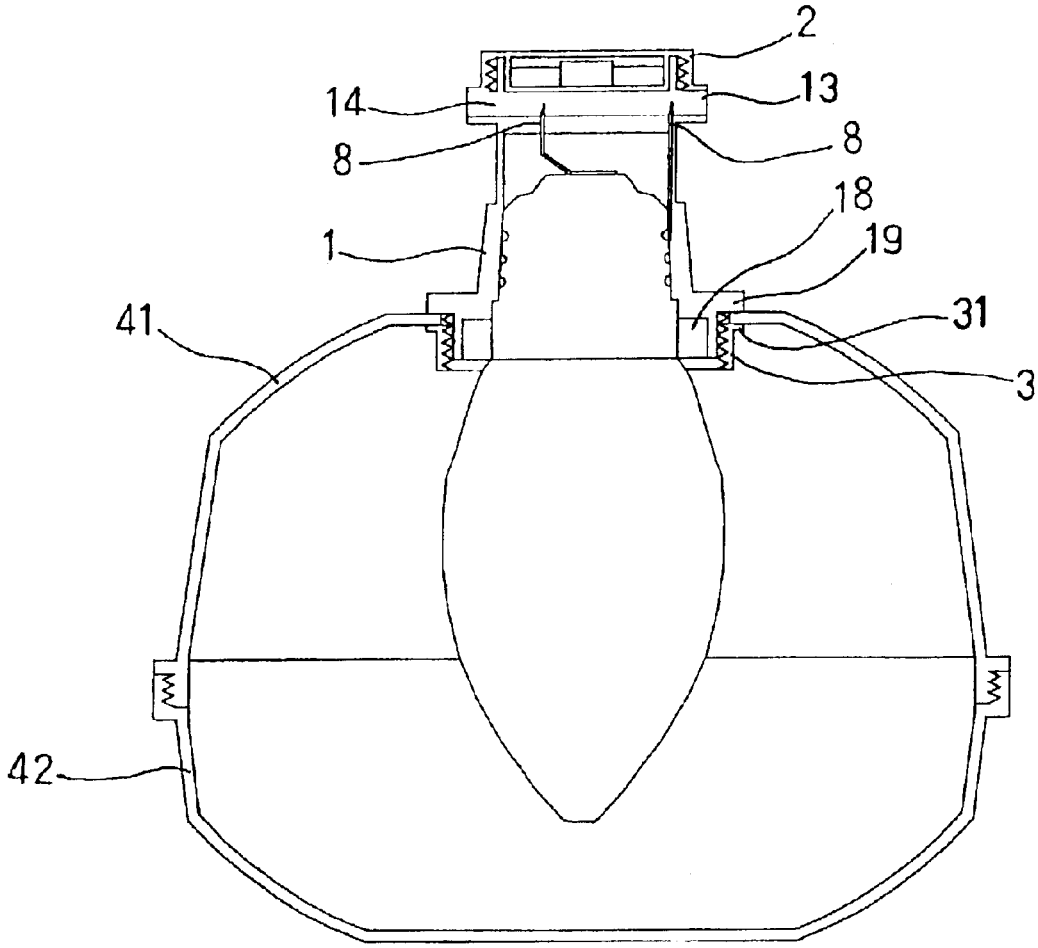
FIG. 8 shows the lamp holder of the present invention having a lamp panel and a lampshade connected thereto.

Please refer back to FIGS. 1 to 3. The socket 1 may further include an externally threaded second connecting head 18 axially extended from a front end of the socket 1 for an internally threaded shade ring 3 to screw thereto. In this case, the socket 1 is provided around a root of the second connecting head 18 with a radially extended front flange 19, and the shade ring 3 is provided around an end facing toward the socket 1 with a ring flange 31. With the second connecting head 18 and the threaded shade ring 3, the socket 1 may be conveniently mounted in an orifice provided on a metal or a wooden signboard 6 through engagement of the second connecting head 18 with the threaded shade ring 3 separately located at rear and front sides of the orifice on the signboard 6, as shown in FIG. 6; or have a lamp panel 41 connected to the socket 1 by clamping a rear end of the lamp panel 41 between the front flange 19 of the socket 1 and the ring flange 31 of the threaded shade ring 3, as shown in FIG. 7; or further have a lampshade 42 connected to a front opening of the lamp panel 41, as shown in FIG. 8. In brief, the lamp holder of the present invention may have changeful appearances for use as decorative illumination or general lighting fixtures in offices and many other working places.

Figure 9:
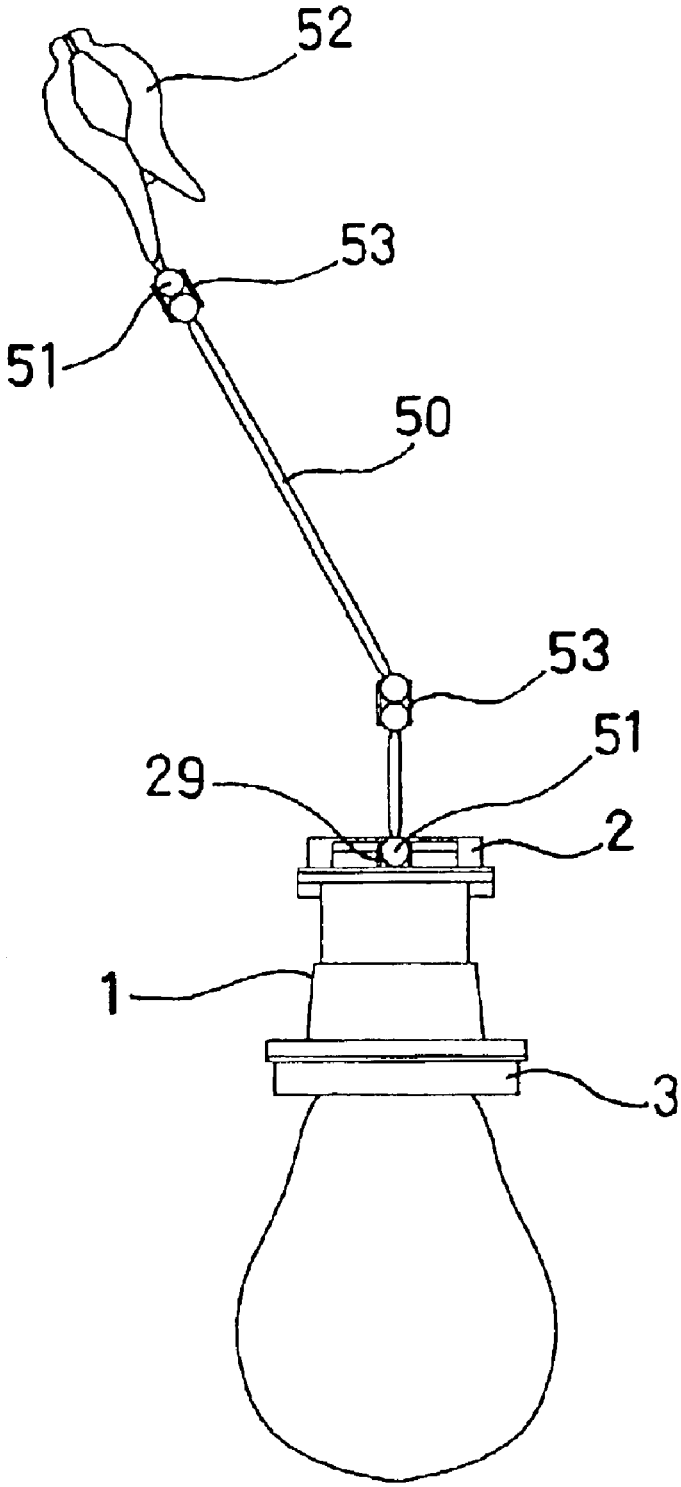
FIG. 9 shows the lamp holder of the present invention is connected to a universal link having a two-jaw chuck provided at a free end thereof.

As can be clearly seen from FIG. 1, the cap 2 is provided in the top recess with a universal socket 29. A universal link 50 having universal joints 53 provided at two ends thereof to separately connect a universal joint ball 51 and a two-jaw chuck 52 may be connected at the universal joint ball 51 to the universal socket 29 on the cap 2, as shown in FIG. 9, so that the lamp holder may be turned by 360 degrees and adjusted to different heights relative to the universal link 50 as desired. The lamp holder may also be conveniently hung on a tree by firmly clamping the two-jaw chuck 52 to, for example, a branch of the tree. When a reflector lamp is mounted on the lamp holder connected to the universal link 50, it may be used as show window lighting or track lighting.

Figure 10:
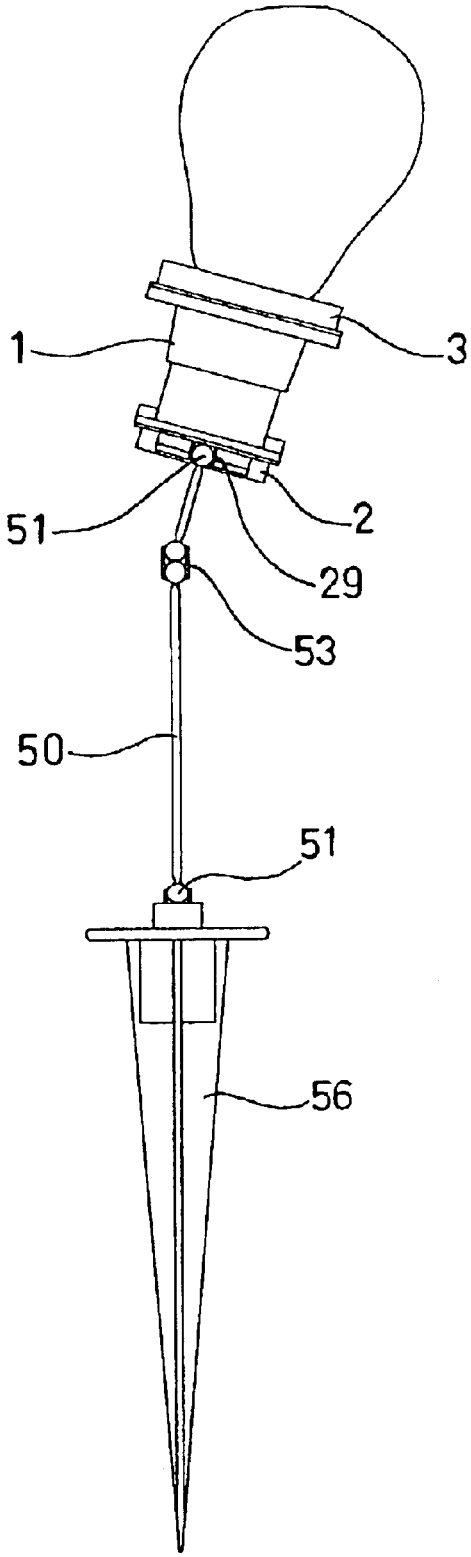
FIG. 10 shows the lamp holder of the present invention is connected to a universal link having a spike provided at a free end thereof.
Figure 11:
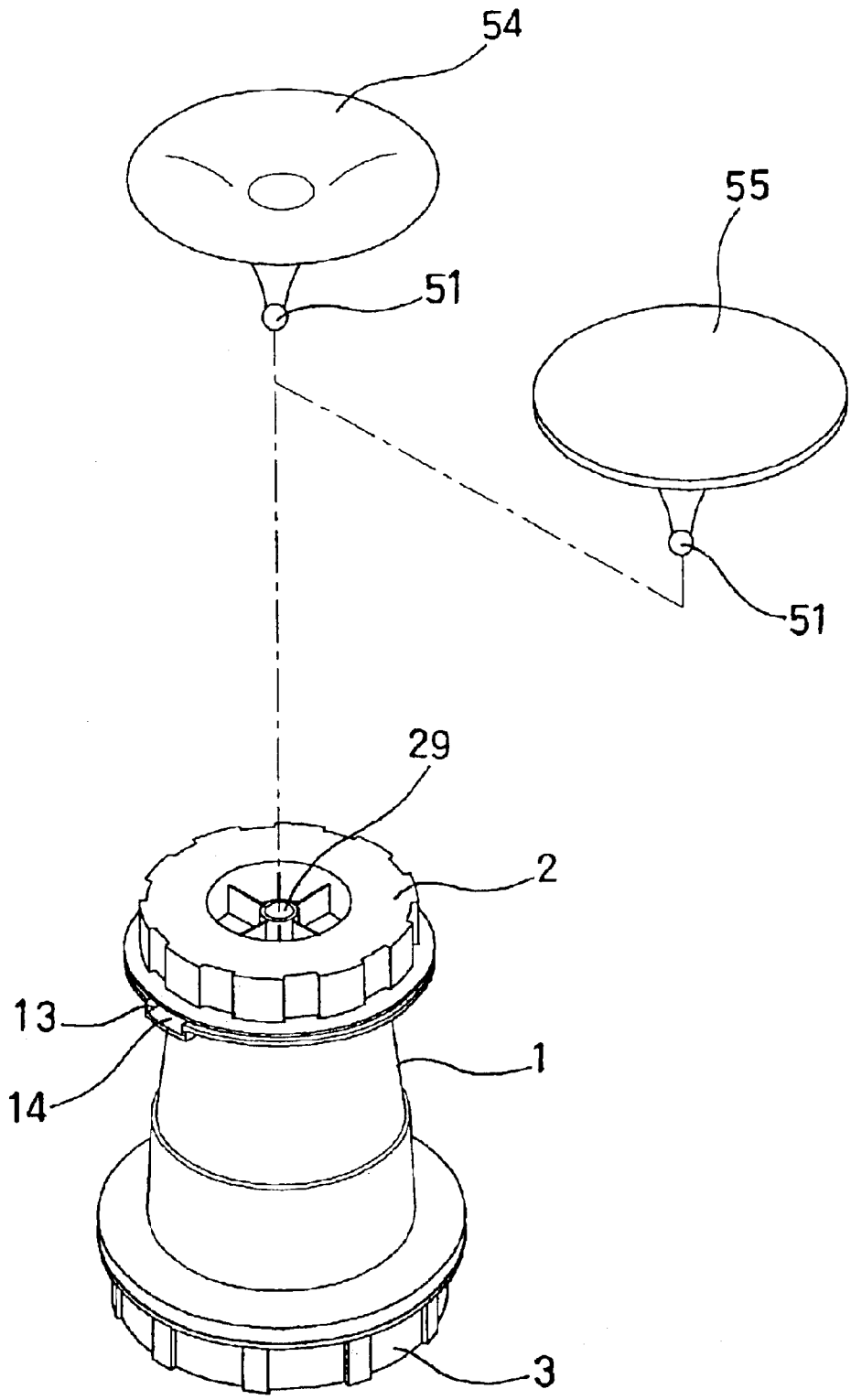
FIG. 11 shows the lamp holder of the present invention may be connected to a sucker or a magnet via a universal-joint ball.
Figure 12:
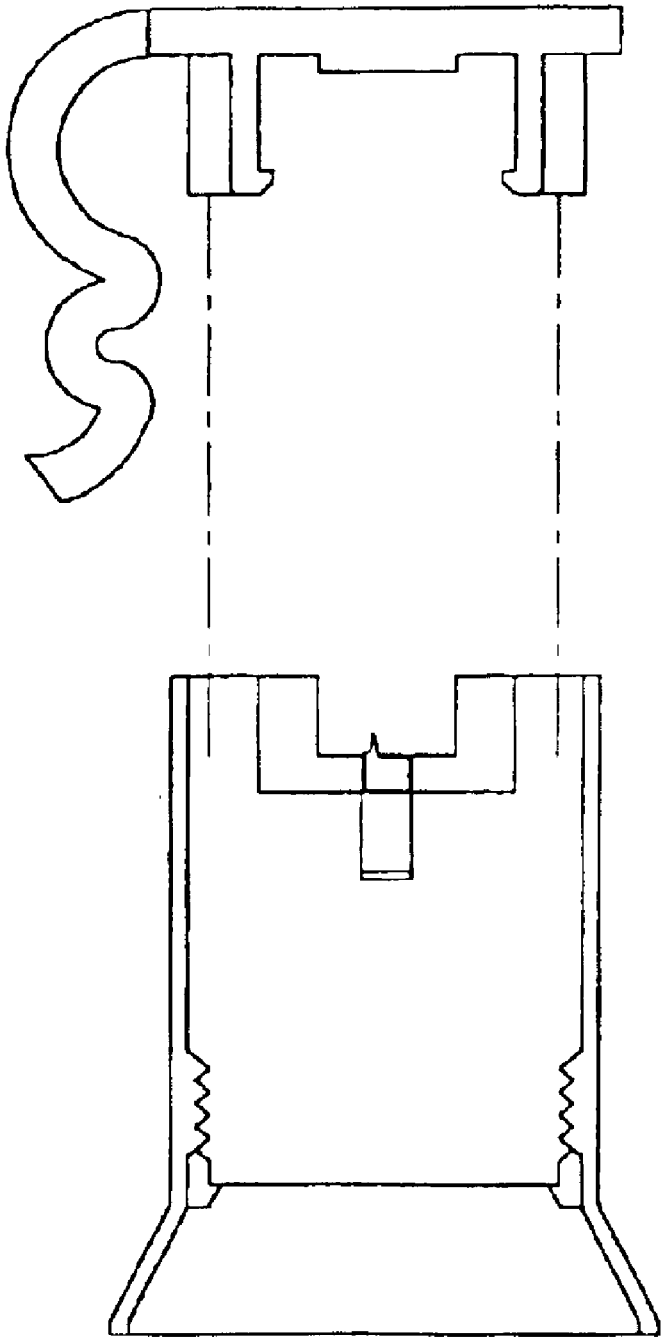
FIG. 12 is a plan view of a conventional lamp holder.

FIG. 10 shows the lamp holder of the present invention is connected at the universal socket 29 on the cap 2 to the universal link 50 having a spike 56 connected to one end thereof. In this manner, the lamp holder may be used outdoors as general garden lighting.

Alternatively, the lamp holder of the present invention may be connected at the universal socket 29 to a sucker 54 or a magnet 55 via the universal joint ball 51. In this manner, a plurality of lamp holders may be attached to a glass or metal surface via their respective sucker 54 or magnet 55, respectively, for forming desired designs, patterns, or letters on the metal or wooden surface.

In conclusion, the lamp holder of the present invention has the following advantages:

1. It can be easily and quickly connected to the cable without using any tool or machine, and is therefore a good do-it-yourself (DIY) product to meet most consumers' requirement.
2. It has simple mechanical and electrical structures and provides enhanced safety for use as compared with conventional lamp holders that use traditional ways to connect to the cable.
3. It has a complete design for a wide range of applications, including light string for festivals, decorative illumination for signboards, show windows, building exterior walls, gardens, offices, different types of working places, streets, etc., and general lighting fixtures.
4. The lamp holders may be connected to the cable at variable intervals according to actual mounting positions thereof, and may be quickly fixed in place without troublesome wiring. The lamp holders may also be easily dismounted from the cable 7 and be used repeatedly, and are therefore environmental friendly.

The present invention has been described with some preferred embodiments thereof and it is understood that many changes and modifications in the described embodiments can be carried out without departing from the scope and the spirit of the invention as defined by the appended claims.

What is claimed is:

1. A lamp holder comprising a socket and a cap;

said socket being internally provided at predetermined positions near a rear end thereof with piercing terminals for directly piercing through an cable assembled to the rear end of said socket and thereby electrically connecting said cable to said lamp holder, said socket also being provided at the rear end with an axially extended and externally threaded first connecting head and a rear flange radially outward extended from a root of said first connecting head; two wiring notches being oppositely provided on said first connecting head, and a sunken wire groove being provided on the rear end and said rear flange of said socket to extend between said two wiring notches; and said wire groove being provided at predetermined positions on a bottom thereof with openings, from which said piercing terminals in said socket are outward projected;

said cap being internally provided with screw threads for engaging with said externally threaded first connecting head, and having a top recess that has a bottom surface adapted to press against said cable positioned in said wire groove; said cap having a cap flange radially outward extended from a periphery of an end of said cap facing toward said socket;

whereby when said cable is connected to said lamp holder by positioning said cable in said sunken wire groove and tightening said cap to said first connecting head of said socket, said bottom surface of said cap and two areas of said cap flange at two opposite sides of said bottom surface together compress against said cable to evenly apply forces in the same direction to three serial points, that is, a front, a middle, and a rear point, on said cable, so that said cable is quickly pierced through by said piercing terminals projected from said openings on said wire groove without becoming misaligned with or skidded off said piercing terminals.

2. The lamp holder as claimed in claim 1, wherein said socket further includes a second connecting head that is externally threaded and axially extended from a front end of said socket for an internally threaded shade ring to screw thereto, and a front flange radially extended from a root of said second connecting head; and said shade ring being provided around an end facing toward said socket with a ring flange.

3. The lamp holder as claimed in claim 2, further comprising a lamp panel and a lampshade; said lamp panel having a first end movably clamped between said front flange on said socket and said ring flange on said shade ring screwed onto said second connecting head of said socket, and a second end to which said lampshade is detachably connected.

4. The lamp holder as claimed in claim 1, wherein said cap is provided in said top recess with a universal socket adapted to receive a universal joint ball provided at an end of a universal link, and said universal link being provided at another end with a chuck.

5. The lamp holder as claimed in claim 1, wherein said cap is provided in said top recess with a universal socket adapted to receive a universal joint ball provided at an end of a universal link, and said universal link being provided at another end with a spike.

6. The lamp holder as claimed in claim 1, wherein said cap is provided in said top recess with a universal socket adapted to receive a universal joint ball provided at an end of a universal link, and said universal link being provided at another end with a sucker.

7. The lamp holder as claimed in claim 1, wherein said cap is provided in said top recess with a universal socket adapted to receive a universal joint ball provided at an end of a universal link, and said universal link being provided at another end with a magnet.

8. The lamp holder as claimed in claim 1, wherein said wire groove on said socket is provided with a replacement opening, and one of said piercing terminals is connected to a auto-reset fuse, such that said fuse-connected piercing terminal is replaceable via said replacement opening.

* * * * *